US007669531B2

(12) United States Patent
Baker et al.

(10) Patent No.: US 7,669,531 B2
(45) Date of Patent: Mar. 2, 2010

(54) PRINTING SYSTEMS AND METHODS

(75) Inventors: Richard John Baker, West Lebanon, NH (US); William Leathers, Quechee, VT (US); Beyhan Aksel, Hanover, NH (US)

(73) Assignee: Dimatix, Inc., Lebanon, NH (US)

( * ) Notice: Subject to any disclaimer, the term of this patent is extended or adjusted under 35 U.S.C. 154(b) by 0 days.

(21) Appl. No.: 11/365,375

(22) Filed: Feb. 28, 2006

(65) Prior Publication Data

US 2006/0193673 A1 Aug. 31, 2006

Related U.S. Application Data

(60) Provisional application No. 60/657,052, filed on Feb. 28, 2005.

(51) Int. Cl.
*B41J 29/38* (2006.01)
*B41F 33/00* (2006.01)

(52) U.S. Cl. ..... 101/484; 347/14; 400/621

(58) Field of Classification Search ..... 101/35, 101/41, 44, 484, 485, 486; 347/2, 4, 5, 14, 347/101, 102, 104, 105; 400/621; 426/383
See application file for complete search history.

(56) References Cited

U.S. PATENT DOCUMENTS

| | | | | |
|---|---|---|---|---|
| 4,019,187 | A | 4/1977 | Omori et al. | |
| 4,281,334 | A * | 7/1981 | Moore et al. | 347/157 |
| 4,905,589 | A * | 3/1990 | Ackley | 101/35 |
| 5,198,871 | A | 3/1993 | Hill, Jr. et al. | |
| 5,223,718 | A | 6/1993 | Taboada | |
| 5,468,262 | A | 11/1995 | Acker et al. | |
| 5,534,281 | A * | 7/1996 | Pappas et al. | 426/383 |
| 5,911,527 | A * | 6/1999 | Aruga et al. | 400/149 |
| 6,637,326 | B1 * | 10/2003 | Isogai et al. | 101/129 |
| 2004/0086603 | A1 * | 5/2004 | Shastry et al. | 426/104 |
| 2004/0211302 | A1 * | 10/2004 | Weber | 83/13 |
| 2005/0012768 | A1 | 1/2005 | Thiessen et al. | |

(Continued)

FOREIGN PATENT DOCUMENTS

GB 2 257 127 1/1993

(Continued)

OTHER PUBLICATIONS

Naegeli, David W., Thermal Stability of Jet Fuels: Kinetics of Forming Deposit Precursors:, Final Report for NASA contract No. NAG 3-1739, NASA Technical Reports, Jun. 1997.

(Continued)

*Primary Examiner*—Leslie J Evanisko
(74) *Attorney, Agent, or Firm*—Fish & Richardson P.C.

(57) ABSTRACT

In general, in a first aspect, the invention features a production system for producing items having an image printed thereon. The production system includes a conveyor configured to carry articles along a path relative to one or more stations of the production line, wherein each article is positioned at a site on the conveyor. The production system also includes a printing station configured to print an image on the articles as the conveyor moves the items past the printing station and an electronic controller configured to provide instructions to the printing station, wherein the electronic controller modifies the printing operation based on the operation of another station in the production system.

17 Claims, 2 Drawing Sheets

U.S. PATENT DOCUMENTS

2005/0225804 A1* 10/2005 Arquilevich et al. ..... 358/1.18
2006/0275532 A1* 12/2006 Dechert ..... 426/383

FOREIGN PATENT DOCUMENTS

JP 57163582 A * 10/1982
JP 02 029745 1/1990
JP 2001315738 A * 11/2001
JP 2002326412 A * 11/2002

OTHER PUBLICATIONS

International Search Report and Written Opinion dated Dec. 18, 2006 from International Application No. PCT/US06/07198.
International Preliminary Report on Patentability dated Sep. 20, 2007 from International Application No. PCT/US06/07198.
Office action issued in co-pending European application No. 06736508.0 dated Dec. 10, 2009.

* cited by examiner

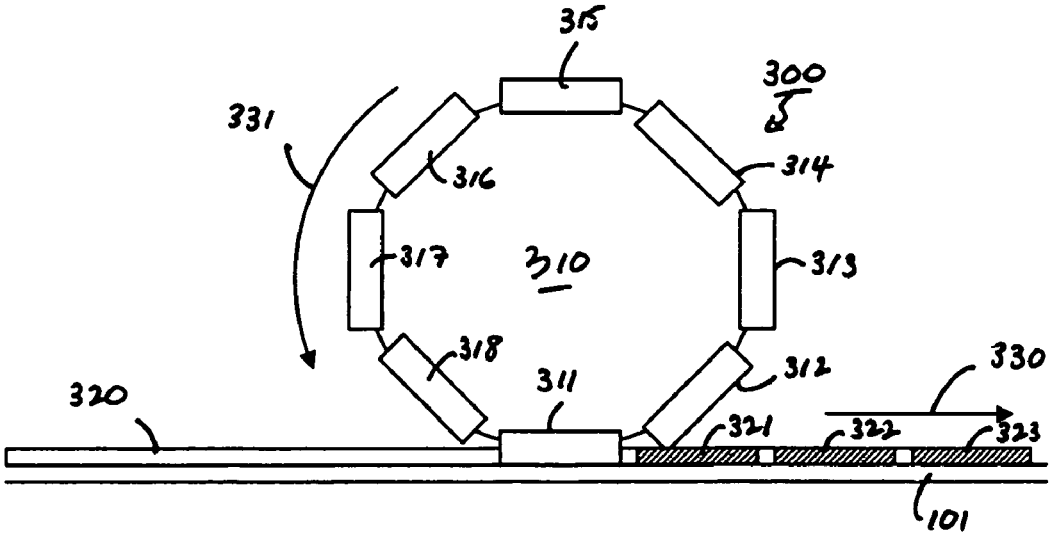
FIG. 3
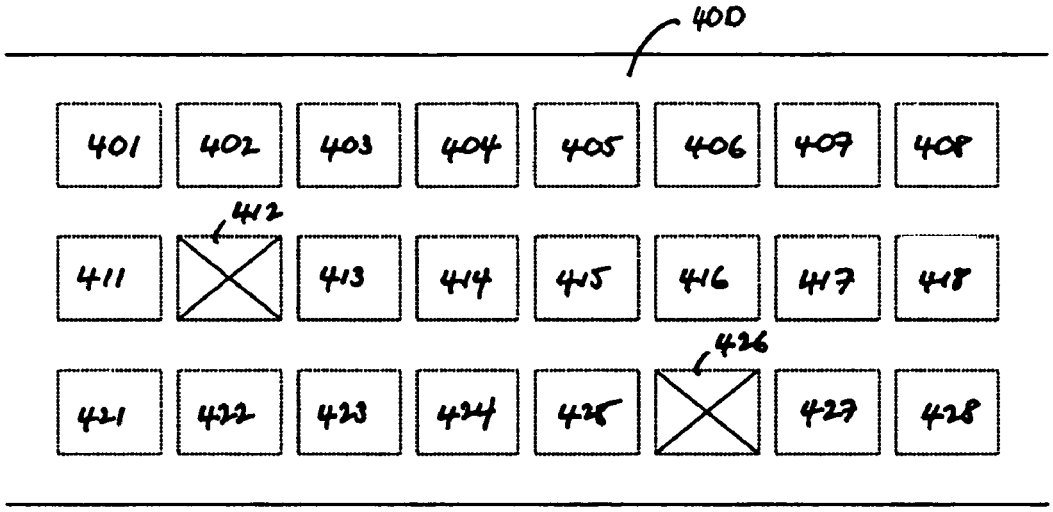
FIG. 4A
$$\begin{Bmatrix} 1 & 1 & 1 & 1 & 1 & 1 & 1 & 1 \\ 1 & 0 & 1 & 1 & 1 & 1 & 1 & 1 \\ 1 & 1 & 1 & 1 & 1 & 0 & 1 & 1 \end{Bmatrix}$$
FIG. 4B

PRINTING SYSTEMS AND METHODS

CROSS-REFERENCE TO RELATED APPLICATIONS

Under 35 U.S.C. §119(e)(1), this application claims priority to Provisional Patent Application No. 60/657,052, entitled "PRINTING SYSTEMS AND METHODS," filed on Feb. 28, 2005, the entire contents of which are hereby incorporated by reference.

TECHNICAL FIELD

This invention relates to printing, and more particularly to printing on articles in a continuous production line.

BACKGROUND

Systems for printing can include droplet ejection devices such as ink jet printers. Ink jet printers typically include one or more printheads. Conventionally, a printhead includes a reservoir and a jetting assembly. The reservoir supplies ink to the jetting assembly, which includes a jetting module that ejects ink droplets as required. In some embodiments, jetting modules each include multiple ink paths that lead from an ink supply to a corresponding orifice path. Each orifice path terminates in a orifice opening from which ink drops are ejected. Ink drop ejection is controlled by pressurizing ink in the ink path with an actuator, which may be, for example, a piezoelectric deflector, a thermal bubble jet generator, or an electro statically deflected element.

Drop ejection from each orifice opening can be independently controlled. In a drop-on-demand printhead, each actuator is fired to selectively eject a drop at a specific pixel location of an image as the jetting assembly and a printing substrate are moved relative to one another. In high performance jetting assemblies, the orifice openings typically have a diameter of about 50 microns or less, e.g., about 25 microns, are separated at a pitch of about 100-300 orifices/inch, have a resolution of about 100 to about 3000 dpi or more, and provide drop sizes of about 1 to about 70 picoliters (pl) or less. Drop ejection frequency is typically about 10 KHz or more.

Hoisington et al. U.S. Pat. No. 5,265,315, the entire contents of which is hereby incorporated by reference, describes a jetting module having a semiconductor body and a piezoelectric actuator. The module body is made of silicon, which is etched to define ink chambers. Orifice openings are defined by a separate orifice plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

Further examples of jetting modules are disclosed in U.S. patent application Ser. No. 10/189,947, entitled "PRINTHEAD," to Andreas Bibl et al., filed on Jul. 3, 2002, the entire contents of which are hereby incorporated by reference.

In general, printheads can include one or more jetting assemblies. Printing systems can print in a single pass of the substrate relative to the printhead, or in multiple passes. Printheads can be used to jet inks and/or other fluids, such as materials used for electronic components (e.g., electrically conductive materials) or color filter materials for flat panel displays, for example.

SUMMARY

Printers can be used to print images (e.g., graphics, text, barcodes) on items in a production line. A station for printing on items can be upstream and/or downstream from other stations (e.g., inspection stations, lamination stations, coating stations, extrusion stations, assembly stations, exposure stations, cutting or dicing stations) in the production line and the operation of the printer can be integrated with the operation of the other stations. Such integration can improve the efficiency and throughput of a production facility.

In general, in a first aspect, the invention features a production system for producing items having an image printed thereon. The production system includes a conveyor configured to carry articles along a path relative to one or more stations of the production line, wherein each article is positioned at a site on the conveyor. The production system also includes a printing station configured to print an image on the articles as the conveyor moves the items past the printing station and an electronic controller configured to provide instructions to the printing station, wherein the electronic controller modifies the printing operation based on the operation of another station in the production system.

Embodiments of the production system can include one or more of the following features. The other station can be upstream or downstream of the printing station. The other station can be an inspection station or a cutting station. The articles can be in the form of discrete articles when they move past the printing station. Alternatively, the articles can be part of a continuous web when they move past the printing station. The other station can include a plurality of components each configured to operate on a corresponding article, and the electronic controller modifies the printing operation based on changes in the operation of each component.

In general, in another aspect, the invention features a system that includes a deposition apparatus including a plurality of droplet ejection modules, the deposition apparatus being configured to deposit droplets on a plurality of portions of a substrate while the substrate moves relative to the deposition apparatus. The system also includes a cutting apparatus having a plurality of cutting tools configured to cut the portions of the substrate while the substrate moves relative to the cutting apparatus. The system further includes an electronic controller configured to control the deposition apparatus so that the deposition apparatus does not print on portions of the web corresponding to one or more disabled cutting tools.

In general, in a further aspect, the invention features a system that includes a deposition apparatus configured to be arranged relative to a substrate path so that the deposition apparatus deposits droplets on a plurality of portions of a substrate moving along the substrate path. The system also includes an electronic controller configured to cause the deposition system to deposit droplets on the plurality of substrate portions, the electronic controller including a programmable data structure (e.g., an array) having a plurality of elements, each element corresponding to a portion of the substrate, wherein for elements programmed to have a first value the deposition apparatus deposits droplets on the corresponding portions of the substrate, whereas for elements programmed to have a second value different from the first value, the deposition apparatus does not deposit droplets on the corresponding portions of the substrate. The elements can also correspond to components of another station upstream or downstream from the deposition system in a production line.

In general, in one aspect, the invention features a method for producing articles having an image printed thereon, the method including conveying articles along a path relative to one or more stations of a production line including a printing station, printing images on articles at a plurality of locations on the path as each article moves past the printing station, and modifying the printing based on information received from one or more stations of the production line.

Implementations may include one or more of the following features. The method can include the step wherein the printing is modified so that the printing station does not print an image at certain locations of the path. The certain locations can be locations that correspond to the absence of an article.

In general, in an aspect, the invention features a production system for producing articles having an image printed thereon, the production system including a conveyor configured to transport articles along a path through the production system, a printing station configured to print images on the articles at a plurality of locations on the conveyor as the conveyor moves the articles past the printing station, a sensing apparatus configured to detect articles on the conveyor, wherein each article corresponds to a location where an image is printed, and an electronic controller configured to provide instructions to the printing station, wherein the electronic controller modifies the operation of the printing station based on information from the sensing apparatus.

Implementations may include one or more of the following features. In the production system, the electronic controller modifies the printing so that the printing station does not print an image at certain locations of the conveyor. The certain locations can be locations that correspond to defects in the articles or missing articles as detected by the sensing apparatus. The printing station can include a plurality of inkjet printing modules configured to print images by depositing droplets on the articles. The ink jet printing modules can be piezoelectric ink jet printing modules. The sensing apparatus can have a plurality of sensors or a camera.

Embodiments of the invention can allow a production system to selectively disable printing for a particular conveyor location if printing on the substrate at that location is undesirable. This can be done without stopping the production line, improving the overall efficiency of the production facility.

Printing at a conveyor location may become undesirable based on the operation of the production system upstream or downstream of the printing station. For example, if a station upstream of the printing stations fails to place an article at a particular conveyor location, subsequent printing at that location can result in wasteful deposition of printing fluid directly onto the conveyor, which can result in increased maintenance costs and downtime of the production line for cleaning the conveyor. Moreover, for expensive deposition fluids, wasteful deposition onto the conveyor can be costly, reducing the overall economy of the production system.

Printing at certain conveyor locations can become undesirable when a station upstream or downstream from the printing station fails. An example of this is where a cutting tool in a cutting station ceases to effectively cut articles from a continuous web. In some embodiments, an upstream printing station prints an image on certain locations of the continuous web that correspond to cutters in the downstream cutting station. If a cutter malfunctions, the corresponding printed portions will not be cut from the web, resulting in waste of the deposited fluid. Moreover, in instances where the remaining web is recycled, the deposited fluid can contaminate the recycled web, resulting in further waste.

Accordingly, among other advantages, the systems and methods can improve the efficiency and throughput of a production line, improving the overall economy of a production facility.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 3 is a cross-sectional view of a cutting tool in a production line.

FIG. 4A is a plan view of a substrate on a conveyor showing article sites corresponding to cutters in an embodiment of a cutting tool.

FIG. 4B is an array for governing the printing operations for printing images onto articles at the article sites shown in FIG. 4A.

Like reference symbols in the various drawings indicate like elements.

DETAILED DESCRIPTION

Figure 1:
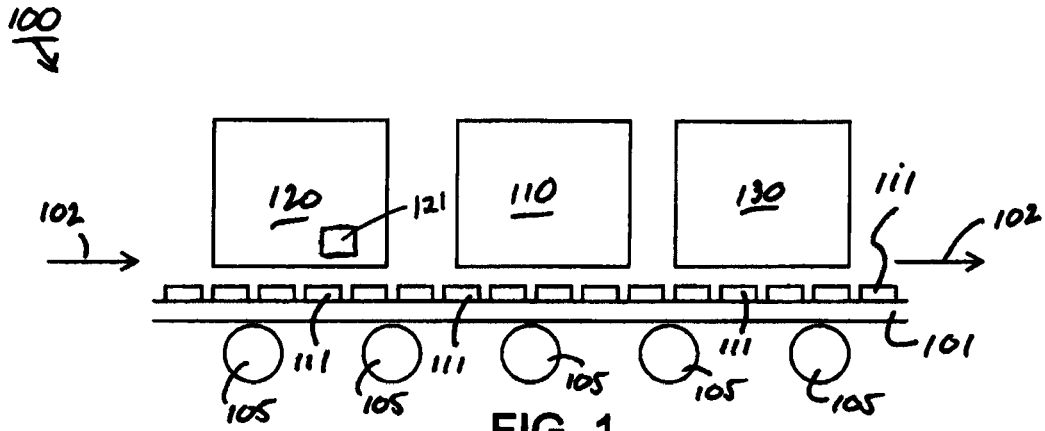
FIG. 1 is a schematic diagram of a portion of a production line that includes a printing station.

Referring to FIG. 1, a portion of a production system 100 includes a printing station 110, a first station 120 upstream of printing station 110, and a second station 130 downstream of printing station 110. Production system 100 also includes a conveyor 101 that carries articles 111 along a path past first station 120, printing station 110, and second station 130. Conveyor 101 moves in the direction of arrows 102, being carried by a number of rollers 105.

Printing station 110 prints an image onto each article as the articles pass by the printing station. Typically, the image is either a graphic image (e.g., a picture), text, or an abstract image (e.g., an abstract logo or a functional abstract image, such as a barcode). In general, the image depends on the specific application for which production system 100 is being used.

In some embodiments, the printed image can vary on an article by article basis. For example, articles can be individualized by printing a different serial number or text message on each article in a batch. Alternatively, in certain embodiments, each article in a batch of articles is printed with the same image.

Although articles 111 are depicted as discrete articles in FIG. 1, in general, the articles can be discrete or can be part of a continuous web. Discrete articles can later be cut or separated from the continuous web (e.g., either before or after printing station 110).

Examples of discrete articles include packaging products (e.g., boxes, bottles, cans, or other containers), individual labels, pharmaceutical products (e.g., individual pills or tablets), food products (e.g., cookies or candies), or electronic components (e.g., microchips). Examples of continuous webs include polymer webs, metal webs (e.g., aluminum foil), or a continuous web of an edible substance (e.g., cookie dough).

The function performed by upstream station 120 also varies depending on the specific application for which production system 100 is being used. In some embodiments, upstream station 120 is an inspection station that inspects (e.g., optically inspects) each article, e.g., for defects and/or to determine its location on conveyor 101.

In certain embodiments, upstream station 120 provides a forming function. For example, upstream station 120 can deposit or attach (e.g., laminate) a material to articles 111, or assemble components of articles 111. In another example, upstream station 120 can be an extrusion station that extrudes a precursor material into a continuous web.

Downstream station 130 can also be configured to perform a variety of operations depending on the specific application for which production system 100 is being used. For example, in some embodiments, downstream station can be a curing station used to dry or set the ink deposited onto articles 111 by printing station 110. Examples of curing stations include an oven (e.g., for evaporating solvent from a solvent based ink), or an exposure station (e.g., a UV exposure station) which irradiates ink deposited on articles 111 with appropriate radiation for setting the ink.

Figure 2A:
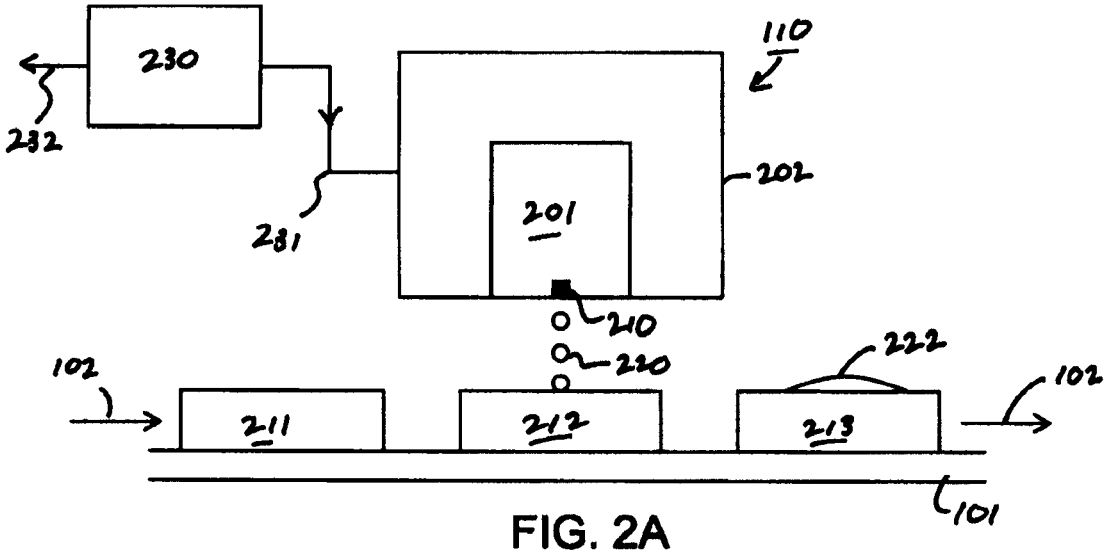
FIG. 2A is a cross-sectional view of a printing station in a production line.

Referring also to FIG. 2A, printing station 110 includes a printhead 202 and an electronic controller 230 that provides instructions to and receives information from printhead 202 over communication line 231. Controller 230 is also in communication with other parts of production system 100 over communication line 232. For example, controller 230 can be in communication with upstream station 120 and/or downstream station 130.

As shown in FIG. 2A, conveyor 101 supports articles 211, 212, and 213 and moves them past printhead 202. As each article passes printhead 202, the printhead prints an image onto the surface of the article. For the snapshot in time represented in FIG. 2A, article 213 is downstream from printhead 202 and has an image 222 already printed on its upper surface. Article 212 is adjacent printhead 202 which prints on its upper surface. Article 211 is upstream of printhead 202 and has yet to be printed on.

Printhead 202 houses a number of jetting assemblies (e.g., piezoelectric ink jet jetting assemblies) which deposit droplets onto the upper surface of each article to form an image as the articles moves relative to the printhead. FIG. 2A shows a single jetting assembly, assembly 201, which ejects droplets 220 from an orifice 210 onto the upper surface of article 212.

Figure 2B:
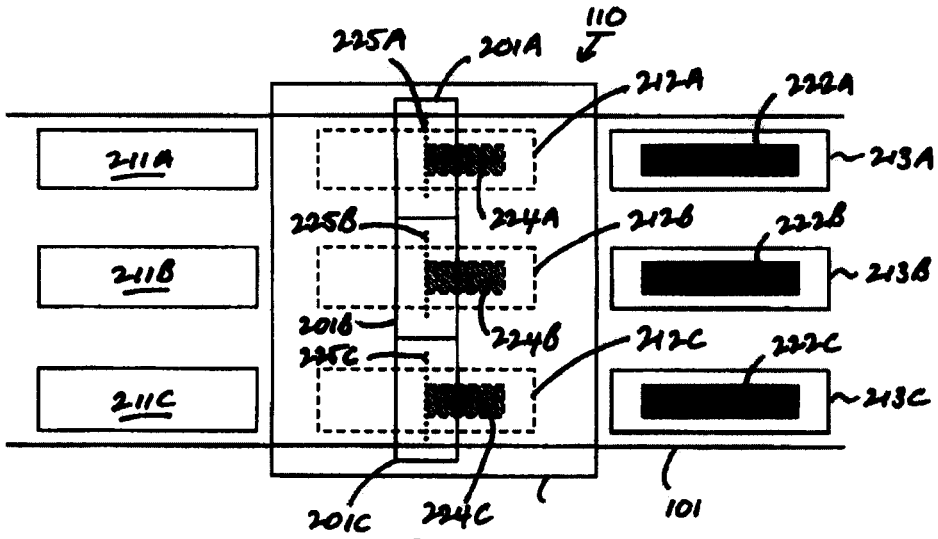
FIG. 2B is a plan view of the printing station shown in FIG. 2A.

Referring further to FIG. 2B, shown in plan view, printhead 202 includes three jetting assemblies 201A-201C that span three lanes on conveyor 101. Each jetting assembly includes an array of orifices (225A-225C) extending in a direction across conveyor 101, spanning the corresponding lane. Conveyor 101 carries articles in each lane, so that three articles are carried past printhead 202 simultaneously. Three articles are shown in each lane in FIG. 2B. Specifically, articles 211A, 212A, and 213A are carried in one lane, and pass by jetting assembly 201A which prints an image on each article as it passes. Correspondingly, articles 211B-213B and articles 211C-213C are carried in other lanes past jetting assemblies 201B and 201C, respectively, which print an image on each article as it passes. The articles downstream from printhead 202, articles 213A-C, are printed with images 222A-C, respectively. Articles 212A-C adjacent printhead 202 are shown printed with image portions 224A-C, respectively, while articles 211A-C are upstream of printhead 202 and are not yet printed on.

While printhead 202 includes three jetting assemblies arranged across conveyor 101, in general, the number of jetting assemblies in a printhead can vary. In some embodiments, a printhead can include more than three jetting assemblies (e.g., four or more, five or more, six or more, seven or more, eight or more, such as 10 or more jetting assemblies). Alternatively, other printheads can include only one or two jetting assemblies.

In general, production system 100 modifies the operation of printing station 110 as needed based on the operation of upstream station 120 and/or downstream station 130. The modification can include adjusting the type, position, or nature of the image to be printed on a particular article, or not printing on a particular article or portion of a substrate at all.

An example of modifying the operation of printing station 110 based on the operation of upstream station 120 is where upstream station 120 is a sensor that determines the presence or absence of an article on the conveyor. For example, in some embodiments, conveyor 101 has discrete wells for holding articles 211A-213C at specific locations on the conveyor. The timing with which printing station 110 prints images is coordinated with the passage of each well location past the print station. However, if for some reason a well is empty, it is desirable to modify the printing operations so that the printing station does not print at that particular well. This is done by inspecting each well for the presence or absence of an article at upstream station 120. The printing station is programmed to print at each well by default. Where an absence is detected, upstream station 120 sends a signal to printing station 110, causing the printing station not to print at the empty well. Alternatively, the upstream station 120 includes a plurality of sensors 121.

An example of a modifying the operation of printing station 110 based on the operation of downstream station 130 is where downstream station 130 includes a tool for cutting (or otherwise separating) printed articles from a continuous or connected web. If a cutter in the cutting tool becomes disabled, the system can instruct the printing station not to print on portions of the web corresponding to the disabled cutter.

Referring to FIG. 3, an example of such a cutting tool is cutting tool 300, which includes a series of cutters 311-318 attached to the outer surface of a drum 310 that rotates in direction 331 as conveyor 101 moves the continuous web 320 past the cutting tool. As drum 310 rotates, the cutters sequentially cut articles from the web. For the snapshot represented in FIG. 3, cutter 311 is cutting an article from web 320. Previously, cutters 312, 313, and 314 had respectively cut articles 321, 322, and 323 from web 320. Upon further rotation of the drum, cutter 318 will cut an article from web 320 upstream from the articles that are already cut.

An example of an application where such a cutting tool can be used is to cut out radio frequency identification (RFID) tags from a continuous web. The printing station can print an identifying image (e.g., a serial number) on each portion of the web corresponding to a tag which is subsequently cut.

One or more of cutters 311-318 can become disabled (e.g., become blunt, broken, or dislodged from drum 300), without substantially affecting the ability of the other cutters to perform their function. In this situation, it can be desirable to modify the printing operation so that the printing station does not print an image onto portions of the web corresponding to the disabled cutter. Not printing on these portions can save ink. Moreover, depositing ink on uncut web portions can contaminate the web material where the uncut web is recycled.

Depending on the application, cutting tool 300 can include only a single series of cutters. In these embodiments, cutting tool 300 cuts a single article from the web for each partial rotation of drum 310. Alternatively, cutting tool 300 can include multiple cutters in the cross-web direction, and cuts a corresponding number of articles from the web for each partial rotation. In some embodiments, a cutting tool can include several (e.g., four, five, six, seven, eight, nine, ten or more) cutters in a cross web direction. Furthermore, while cutting tool 300 includes a series of eight cutters around the circumference of drum 310, in general, this number can vary.

Moreover, other types of cutting tools can also be used. For example, instead of a rotating array of cutters arranged on the surface of a cylindrical drum, a cutting tool can have a planar array of cutters that stamp out articles from a web as the conveyor moves the web past the cutting tool.

For cutting tools such as tool 300, where there are a plurality of cutters that cut articles from the web, the web can be represented as including an array of sites each corresponding to a different cutter. The printing station should be configured to print an image at each of these sites, which are then cut from the web as the sites pass the downstream cutting tool. For example, referring to FIG. 4A, where a cutting tool includes three lanes of eight cutters, a length of web 400 corresponding to one rotation of the cutting tool includes a three by eight array of sites 401-408, 411-418, and 421-428 that the printing station should print on.

One way to modify the printing station's operation based on the operation of the cutting tool is as follows. The electronic controller that controls the printing station can include a data structure having elements corresponding to each cutter. The value for each element represents the status of the corresponding cutter. For example, where a cutter is functioning properly, the corresponding element can be set to "1." If a cutter is not functioning, the corresponding element can be set to "0." Referring also to FIG. 4B, an array corresponding to cutters for sites 401-408, 411-418, and 421-428 is shown where the cutters for sites 412 and 426 are not functioning. Since the web moves past the printing station, the controller reads the array column corresponding to the row of sites being printed on and instructs the printing station to print on the substrate accordingly. For example, where sites 401, 411, and 421 are adjacent the printhead, the controller reads the first column of the array. As all the elements in the first column have a value "1," the printing station prints images on all three sites. However, where sites 402, 412, and 422 are adjacent the printhead, the controller reads the second column in the array and prints only on sites 402 and 422 but not on element 412 since the elements corresponding to sites 402 and 422 are set to "1" while the element corresponding to site 412 is set to "0." The array can be updated as necessary, either manually or automatically.

More generally, the concept of having an updatable data structure for controlling printing based on the operation of or feedback from another station in the production system can be used for other operations in addition to cutting. For example, where the production system presents discrete articles to the printing station at specific sites (e.g., in wells on the conveyor), an inspection station upstream of the printing station can identify sites where no article is positioned and can update a corresponding data structure accordingly so that the printing station does not print at those sites.

Although the foregoing discussion refers to a printing station which prints an image onto each article produced, in certain embodiments the printing station can be used to deposit materials onto articles for purposes other than forming an image. Correspondingly, in such embodiments, the deposited material may not be ink. Deposited materials can include optical materials, including passive optical materials such as materials for forming filter arrays, or emissive optical materials such as materials used to form organic light emitting diodes. Further examples of fluids that can be deposited are adhesive materials and electronic materials, such as electrically conductive polymers.

In embodiments where the deposited fluid is extremely expensive it can be particularly advantageous to modify the printing operation to prevent printing at sites that won't provide a viable product (e.g., an empty site or a site that won't be cut from the web). Furthermore, it is also particularly advantageous to prevent printing at empty sites where the deposited material would contaminate the conveyor and require labor intensive cleanup.

A number of embodiments of the invention have been described. Nevertheless, it will be understood that various modifications may be made without departing from the spirit and scope of the invention. Accordingly, other embodiments are within the scope of the following claims.

What is claimed is:

1. A production system for producing articles, at least some articles each having an image printed on the article, the production system comprising:

a conveyor to carry a substrate for one or more of the articles along a path relative to one or more stations of the production system, wherein each article corresponds to an article site on the substrate;

a printing station configured to print the image at the one or more article sites as the conveyor moves the substrate past the printing station; and an electronic controller to modify a printing operation so that, without stopping the production system, the printing station does not print the image at certain article sites, based on an improper operation of another station in the production system, so that articles on which no images are printed are produced with respect to the certain article sites.

2. The production system of claim 1, wherein the another station is downstream of the printing station.

3. The production system of claim 1, wherein the another station comprises a cutting station.

4. The production system of claim 1, wherein the improper operation is associated with a disabled cutter.

5. The production system of claim 1, wherein the substrate corresponds to one article.

6. The production system of claim 1, wherein the substrate is a continuous web.

7. The production system of claim 1, wherein the another station comprises a plurality of components each configured to operate on a corresponding article site, and the electronic controller modifies the printing operation based on the improper operation of at least one of the components.

8. The production system of claim 7, wherein the plurality of components comprises a plurality of cutters.

9. The production system of claim 7, wherein the electronic controller includes a data structure comprising elements each having a value corresponding to a status of each of the components in the another station.

10. The production system of claim 9, wherein the data structure comprises an updatable data structure.

11. The production system of claim 1, wherein the improper operation of another station includes the another station being disabled.

12. The production system of claim 1, wherein the printing station is downstream and the another station is upstream relative to the printing station.

13. The production system of claim 1, wherein the printing station is configured to continue to print during the improper operation of another station.

14. A method for producing articles, at least some of the articles each having an image printed on the article, the method comprising:

conveying a substrate for one or more of the articles along a path relative to one or more stations of a production line including a printing station, wherein each article corresponds to an article site on the substrate;

printing images at the one or more article sites as the substrate moves past the printing station; and modifying the printing of the printing station to not print images at certain article sites without stopping conveying the substrate based on an improper operation of one or more stations of the production line, so that articles on which no images are printed are produced with respect to the certain article sites.

15. The method of claim 14, wherein the improper operation includes the one or more stations being disabled.

16. The method of claim 14, further comprising simultaneously continuing to print at other article sites during the improper operation of one or more stations of the production line.

17. The method of claim 14, wherein the one or more stations comprise a plurality of components each configured to operate on a corresponding article site, and the modifying the printing based on the improper operation of at least one of the components.

* * * * *